United States Patent [19]

Cook

[11] Patent Number: 4,984,500

[45] Date of Patent: Jan. 15, 1991

[54] AMMUNITION CASING EXTRACTOR

[75] Inventor: Mark A. Cook, Orlando, Fla.

[73] Assignee: The United States of America as represented by the Secretary of the Air Force, Washinhgton, D.C.

[21] Appl. No.: 506,415

[22] Filed: Apr. 6, 1990

[51] Int. Cl.[5] ..... C06B 21/00; F42B 39/10

[52] U.S. Cl. ..... 86/1.1; 86/48; 86/49; 89/34

[58] Field of Search ..... 86/1.1, 47–49; 89/34

[56] References Cited

U.S. PATENT DOCUMENTS

| | | | |
|---|---|---|---|
| 1,401,147 | 12/1921 | Farr | 86/48 |
| 4,137,820 | 2/1979 | Clemens | 89/33 |
| 4,281,583 | 8/1981 | Pollock et al. | 89/33 |
| 4,290,339 | 9/1981 | Skahill | 89/33 |
| 4,509,401 | 4/1985 | Pollock | 86/48 |
| 4,572,052 | 2/1986 | Johnson | 89/33 |
| 4,881,447 | 11/1989 | Yanusko | 86/48 |

*Primary Examiner*—Harold J. Tudor

*Attorney, Agent, or Firm*—Bobby D. Scearce; Donald J. Singer

[57] ABSTRACT

A device for extracting ammunition casings from linked tubes of a flexible ammunition carrier is described which in a preferred representative embodiment comprises a generally tubular chute having an upper wall and a lower wall and first and second side walls which are divergent from each other along the length of the chute thereby defining a passageway through the chute extending from an entrance end to an exit end thereof which substantially uniformly increases in width along the length thereof; first and second channels defined along respective first and second side walls of the chute and configured to diverge one from the other in correspondence with the divergence of the first and second side walls and sized to receive respective annular flanges on the casings and the tubes of the ammunition carrier; and a rotatable paddle wheel disposed near the entrance end of the chute and including a plurality of paddles sized and spaced to engage spaces between adjacent tubes of the ammunition carrier which provides means for forcing the ammunition carrier through the chute whereby the respective annular flanges of the casings and tubes are separated along the length of the chute in correspondence with the divergence of the first and second channels and the casings are thereby separated from the tubes near the exit end of the chute.

2 Claims, 2 Drawing Sheets

AMMUNITION CASING EXTRACTOR

RIGHTS OF THE GOVERNMENT

The invention described herein may be manufactured and used by or for the Government of the United States for all governmental purposes without the payment of any royalty.

BACKGROUND OF THE INVENTION

The present invention relates generally to handling systems for belted ammunition, and more particularly to a portable device for extracting spent ammunition casings from a flexible linked tube ammunition carrier, which is simple to operate and can be used in applications remote from conventional sources of power.

Weapon staging area functions include downloading of spent ammunition from weapon systems. It is highly desirable to remove casings from spent ammunition carried in flexible belted carriers so that the empty flexible carrier may be reused in the staging area or returned to the supplier for refilling with new rounds. Extracting spent casings from flexible ammunition belts can be particularly difficult and time consuming because of the weight and unwieldiness of the belts. Presently used systems for extracting casings are generally electrically powered and require several persons to operate.

The invention eliminates or substantially reduces in critical importance problems with conventional systems by providing a portable, manually operated device for quickly and easily removing spent ammunition casings from a flexible ammunition belt. The invention is characterized by its light weight and lack of requirement for an external source of power. The extractor is attachable directly to standard ammunition cans, and carries an ammunition belt through a chute defining internally flanged channel on either side thereof for engaging on one side of the chute the annular flanges on the casings and on the other side of the chute the annular flanges on one end of the tubes comprising the flexible ammunition carrier. The chute is configured so that the two channels diverge along the length of the chute from the entrance end to the exit end whereby as the carrier is forced through the chute the casings are separated from corresponding tubes of the carrier. A manually operated feed paddle wheel may be mounted on the chute for forcing the carrier along the chute.

It is therefore a principal object of the invention to provide a light weight, portable device for extracting spent ammunition casings from a flexible ammunition carrier.

It is a further object of the invention to provide a manually operated extractor for separating spent casings from a flexible ammunition carrier requiring no external source of power.

These and other objects of the invention will become apparent as a detailed description of representative embodiments proceeds.

SUMMARY OF THE INVENTION

In accordance with the foregoing principles and objects of the invention, a device for extracting ammunition casings from linked tubes of a flexible ammunition carrier is described which in a preferred representative embodiment comprises a generally tubular chute having an upper wall and a lower wall and first and second side walls which are divergent from each other along the length of the chute thereby defining a passageway through the chute extending from an entrance end to an exit end thereof which substantially uniformly increases in width along the length thereof; first and second channels defined along respective first and second side walls of the chute and configured to diverge one from the other in correspondence with the divergence of the first and second side walls and sized to receive respective annular flanges on the casings and the tubes of the ammunition carrier; and a rotatable paddle wheel disposed near the entrance end of the chute and including a plurality of paddles sized and spaced to engage spaces between adjacent tubes of the ammunition carrier which provides means for forcing the ammunition carrier through the chute whereby the respective annular flanges of the casings and tubes are separated along the length of the chute in correspondence with the divergence of the first and second channels and the casings are thereby separated from the tubes near the exit end of the chute.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
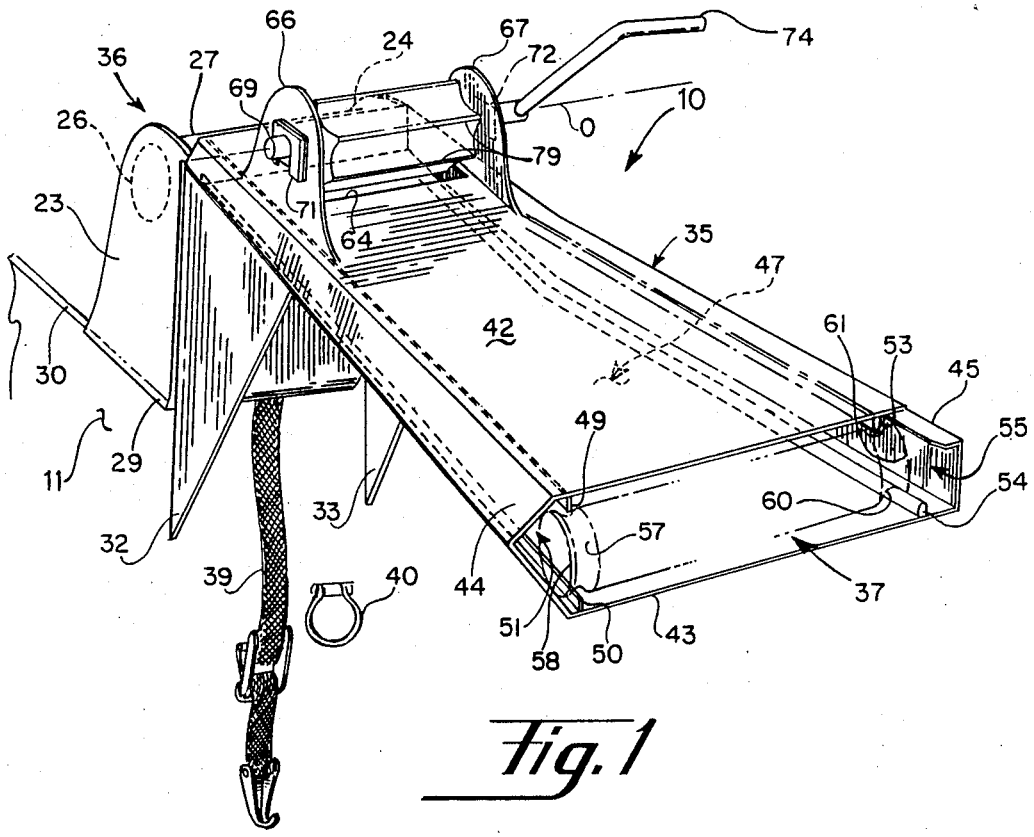
FIG. 1 is a perspective view of the ammunition casing extractor of the invention.
Figure 2:
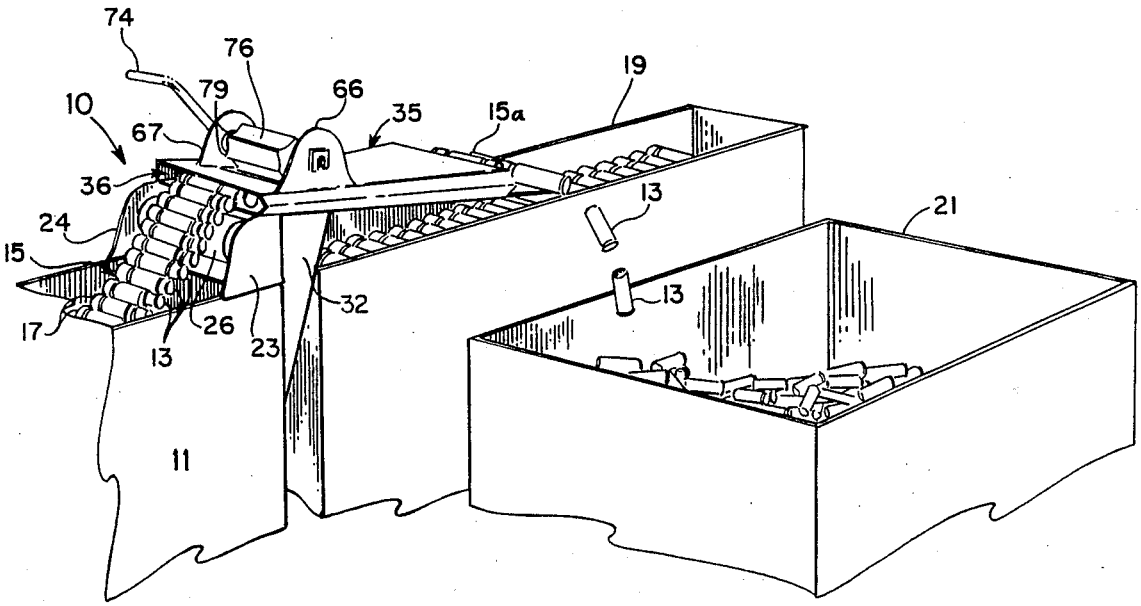
FIG. 2 is shows the extractor of FIG. 1 in place on an ammunition shipping can.

Referring now to the drawings, FIG. 1 shows a perspective view of the ammunition casing extractor 10 of the invention. FIG. 2 shows extractor 10 in place on an ammunition shipping can 11. In accordance with a principal object of the invention, extractor 10 is configured for extracting casings 13 of spent ammunition contained in ammunition belts, such as the linked tube carrier 15 shown in FIG. 2. Casings 13 may normally comprise brass. Carrier 15 is a conventional configuration for carrying large caliber ammunition (e.g. 30 mm) and in which the ammunition is received from a supplier, and comprises a plurality of linked tubes 17 each sized to carry a round of ammunition of corresponding size carried in casings 13. A substantially continuous carrier 15 of considerable, often indeterminant length is transported or stored in or downloaded from a weapon system into can 11 in layers as suggested in FIG. 2. The extraction process contemplated using extractor 10 by which casings 13 are removed from tubes 17 of carrier 15 is performed by feeding carrier 15 (containing casings 13) from can 11 through extractor 10. The empty carrier **15*a* is layered into a second shipping/storage can 19, as suggested in FIG. 2, for reuse within the weapon staging area or for shipment back to the supplier for refilling. The extracted ammunition casings 13 are collected in a bin or crate 21 placed adjacent can 19 near the discharge end of extractor 10**.

Referring now specifically to FIG. 1, extractor 10 may comprise a pair of upright wall members 23 and 24 held in preselected spaced relationship to each other by spacer bar 26 presenting a smooth surface 27 over which carrier 15 containing casings 13 may slide as it is fed into extractor 10. The spacing between wall members 23 and 24 corresponds in size with the size of carrier 15 and the width of can 11. Wall members 23 and 24 are supported by any suitable means for clamping or otherwise attaching extractor 10 to can 11, such as flanges 29 on the lower ends of wall members 23 and 24 which are configured to be received by lips 33 on each side of can 11. Other configurations may be envisioned by one skilled in the applicable art to hold extractor 10 stationary relative to can 11. Braces 32 and 33 attached to wall members 23 and 24 support a generally tubular chute 35 having entrance end 36 and exit end 37 through which carrier 15 is fed in the process of extracting casings 13 therefrom as described more fully below. Wall members 23 and 24, spacer 26, braces 32 and 33, chute 35 and other elements of extractor 10 may be constructed of any material having suitable structural strength, such as steel or aluminum, a unit built in demonstration of the invention being constructed of aluminum providing a desirable combination of strength, durability and light weight. Assembly may be by welding.

Extractor 10 may be secured to can 11 using a conventional cargo strap 39 attachable to bracket or ring 40 normally attached to the side of cans 11 for handling purposes.

Figure 3:
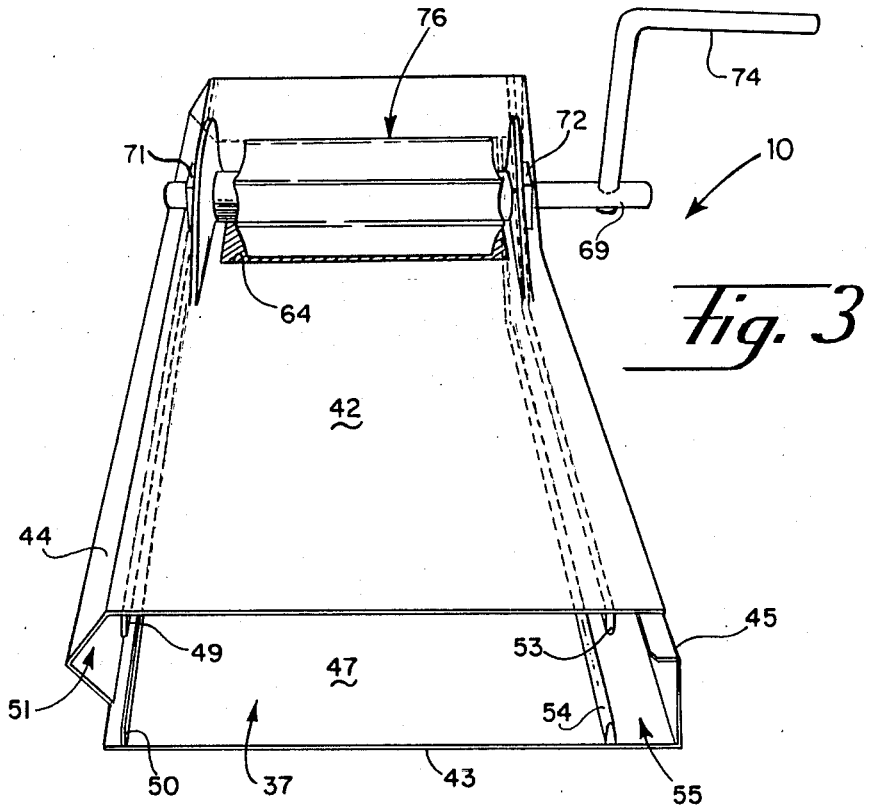
FIG. 3 shows a perspective view of the exit end of the FIG. 1 embodiment.

Chute 35 comprises upper wall 42, lower wall 43 and side walls 44 and 45 defining passageway 47 extending from entrance end 36 to exit end 37. For purposes defined fully below, chute 35 is configured to define passageway 47 which uniformly increases in width from a point near entrance end 36 to exit end 37 as is best seen in FIG. 3. Upper and lower flanges 49 and 50 may be disposed on the inner surfaces of upper and lower walls 42 and 43 a preselected uniform distance from side wall 44 to define channel 51 of uniform width extending substantially the entire length of chute 35 along the right side thereof (as entrance end 36 is viewed). Likewise, upper and lower flanges 53 and 54 are disposed on the inner surfaces of upper and lower walls 42 and 43 a preselected uniform distance from side wall 45 to define channel 55 of uniform width extending substantially the entire length of chute 35 along the left side thereof.

Referring again to FIG. 1, shown in phantom at exit end 37 of chute 35 is a single tube 17 of carrier 15 and a casing 13 to be extracted therefrom. It is noted that each casing 13 has near the closed end thereof an annular groove 57 defining annular flange 58. Each tube 17 of carrier 15 has at one end thereof (corresponding to the bullet end of the ammunition rounds) an annular groove 60 defining annual flange 61 thereon. Flanges 49 and 50 are sized and spaced so as to ride in annular groove 57 of casing 13 and restrain annular flange 58 within channel 51 as carrier 15 is fed through chute 35. Flanges 53 and 54 are likewise sized and spaced to ride in annular groove 60 of tube 17 and restrain annular flange 61 within channel 55 as carrier 15 is fed through chute 35. It is noted therefore according to a governing principle of the invention, that as carrier 15 is fed through chute 35 from the entrance end 36 to the exit end 37 thereof, casing 13 will be pulled from the corresponding tube 17 by reason the divergence of channels 51 and 55 along the length of chute 35. Suitable sizing of entrance end 36 of chute 35 will allow the overall width of carrier 15 containing casings 13 to be accommodated with annular flanges 58 of casings 13 entering channel 51 and annular flanges 61 of tubes 17 entering channel 55. Suitably sizing exit end 37 will provide that casings 13 are just pulled from the corresponding tubes 17 thereat, the casings 13 being allowed to accumulate in crate 21, and the empty carrier 15' to accumulate in can 19 as illustrated in FIG. 2. It is noted that the upper surface of chute 35 at upper wall 42 need not necessarily be closed, although it is apparent from a reading hereof that chute 35 is preferably substantially closed along the length thereof to retain carrier 15 in a substantially flat configuration as it is fed through chute 35.

Carrier 15 may be fed through chute 35 by any suitable means as would occur to the skilled artisan guided by these teachings, although for purposes of imparting portability to extractor 10 and operability without the need for an independent power source, the mechanism best illustrated in FIGS. 1 and 2 may be preferred. An opening 64 may be cut out of upper wall 42 near entrance end 36 of chute 35 of width approximating the width of carrier 15 and preselected length. Two upright wall members 66 and 67 may be attached to upper wall 42 and rotatably supporting an axle 69 disposed between wall members 66 and 67 and journaled for rotation about axis 0 at bearing mounts 71 and 72 in wall members 66 and 67. Axle 69 extends through wall member 66 and has attached thereto crank handle 74. Feed paddle wheel 76 is disposed on axle 69 for rotation therewith about axis 0, and includes a suitable plurality (six in the FIG. 1 embodiment) of axially extending concavities 78 spaced therearound and defined between a corresponding plurality of axially extending paddles 79. Each concavity 78 is sized and shaped for receiving successive tubes 17 in carrier 15 and paddles 79 are sized in height and thickness to fit between adjacent tubes 17 as carrier 15 is fed through chute 35. Axle 69 is disposed relative to opening 64 so that paddles 79 engage openings between successive tubes 17 and so that rotation of feed paddle 76 forces carrier 15 through chute 35. As suggested above, the process of forcing carrier 15 through chute 35 effects separation of casings 13 from the corresponding tubes 17. The last few tubes 17 near the end of carrier 15 may be manually pulled though chute 35 to remove the casings 13 therefrom.

In a unit built in demonstration of the invention, extractor 10 was constructed substantially of aluminum assembled by welding. The demonstration unit weighed about 40 pounds and was configured specifically for 30 mm shells in a belted configuration. Accordingly, the unit was sized to span an ammunition can about 13 inches wide. Overall length of the unit was about 24 inches with an entrance end width about $11\frac{3}{4}$ inches (corresponding to the width of the carrier with casing) and an exit end width about $16\frac{1}{2}$ inches (corresponding approximately to the sum of carrier width and casing length). It is further noted that an extractor device for casings and flexible ammunition carriers of sizes different from that for which the demonstration unit was built may be assembled based upon the teachings hereof. Size of the invention is therefore not considered limiting of the invention.

It is noted that the process of extracting casings from a linked tube ammunition carrier using the extractor 10 may require the cooperative services of no more than two persons, one to turn crank handle 74 to effect separation of casings 13 from the corresponding tubes 17, and one to arrange carrier 15 within can 19 as carrier 15 is passed out of chute 35. Conventional techniques may require four or more persons for the same task. The invention provides a further advantage over conventional techniques in that electrical power is not required, i.e., the extraction process using the invention can be performed at locations remote from sources of power.

The invention therefore provides an improved extractor for removing spent casings from a flexible linked tube ammunition carrier, which is characterized by simplicity of operation and utility in applications remote from conventional power sources. It is understood that modifications to the invention may be made as might occur to one skilled in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A device for extracting ammunition casings from linked tubes of a flexible ammunition carrier, comprising:

(a) a generally tubular chute having an entrance end and an exit end, said chute comprising an upper wall, a lower wall and first and second side walls, said side walls being divergent from each other along the length of said chute substantially from said entrance end to said exit end thereby defining a passageway therethrough extending from said entrance end to said exit end which substantially uniformly increases in width from near said entrance end to said exit end, said entrance end of said chute sized to receive said flexible ammunition carrier and said casings contained therein;

(b) first and second channels along respective said first and second side walls of said chute, said channels configured to diverge one from the other in correspondence with the divergence of said first and second side walls, said channels sized to receive respective annular flanges on said casings and said tubes of said flexible ammunition carrier; and (c) means for forcing said flexible ammunition carrier through said chute from said entrance end to said exit end whereby respective said annular flanges of said casings and said tubes of said flexible ammunition carrier are separated along the length of said chute in correspondence with the divergence of said first and second channels, and said casings are thereby separated from said tubes of said flexible ammunition carrier near said exit end of said chute.

2. The device of claim 1 wherein said means for forcing said flexible ammunition carrier through said chute comprises a rotatable paddle wheel disposed near said entrance end of said chute, said paddle wheel including a plurality of paddles sized and spaced to engage spaces between adjacent tubes of said flexible ammunition carrier and thereby force said flexible ammunition carrier along said chute with rotation of said paddle wheel.

* * * * *